US005596859A

United States Patent [19]

Horton et al.

[11] Patent Number: 5,596,859

[45] Date of Patent: Jan. 28, 1997

[54] METAL WALL STUD

[76] Inventors: Jim W. Horton, 1307 River Hills Cir. East, Apt. #8, Jacksonville, Fla. 32211; Harvel K. Crumley, 3395 Lighthouse Pointe La., Jacksonville, Fla. 32250

[21] Appl. No.: 308,989

[22] Filed: Sep. 20, 1994

[51] Int. Cl.[6] ..... E04C 3/32

[52] U.S. Cl. ..... 52/733.3; 52/656.6; 52/660; 52/731.5; 52/731.9

[58] Field of Search ..... 52/732.1, 732.3, 52/733.2, 733.3, 737.6, 731.7, 731.8, 731.9, 720.1, 730.6, 731.1, 731.2, 731.4, 731.5, 349, 481.1, 481.2, 483.1, 660, 317, 739.1; 428/598, 603; 29/897, 897.3, 897.33, 897.312

[56] References Cited

U.S. PATENT DOCUMENTS

| | | | |
|---|---|---|---|
| Re. 34,022 | 8/1992 | Davis | 52/733.2 |
| 1,862,831 | 6/1932 | Ryan | 52/349 |
| 2,204,493 | 6/1940 | Henry | 52/720.1 |
| 3,243,930 | 4/1966 | Slowinski | 52/731.9 |
| 4,572,695 | 2/1986 | Gilb | 248/300 |
| 5,440,848 | 8/1995 | Deffey | 52/660 |

FOREIGN PATENT DOCUMENTS

| | | | |
|---|---|---|---|
| 990041 | 6/1976 | Canada | 52/731.2 |
| 939599 | 11/1948 | France | 52/731.2 |
| 92/17659 | 10/1992 | WIPO | 52/481.2 |

*Primary Examiner*—Michael Safavi
*Attorney, Agent, or Firm*—Arthur G. Yeager

[57] ABSTRACT

A metal wall stud in the shape of an elongated open channel having pre-punched nail or screw holes and pre-punched passageways for electrical or plumbing facilities. Integral tabs extending beyond the ends of stud walls are foldable to provide connections to wooden plates or metal wall stud purlins in the construction framing. Split tabs integral with the bottom wall of the channel provide lateral stabilization, greater uplift loads, and the capability of being load bearing. A pair of studs have nesting capability to provide telescopic adjustability for walls in a vaulted ceiling room.

20 Claims, 3 Drawing Sheets

METAL WALL STUD

BACKGROUND OF THE INVENTION

Residential housing and much commercial building has in the past been made in the United States and in other countries with wooden supporting structures, most of it in the form of elongated beams of standard sizes in inches, such as 2×2, 2×4, 2×6, 2×8, 2×10, 2×12, 4×4, 4×6, 4×8, 4×10, and 4×12. Due to the decreasing supplies of wood and the corresponding increasing costs of wooden beams, attempts have been made to employ steel beams in place of wooden beams for this type of construction. Typical of such attempts are the metal beams shown in U.S. Pat. Nos. 4,001,993; 4,058,951; 4,130,970; 4,793,113; 4,809,476; 5,157,883; and 5,222,335. While these inventions are suitable for many purposes, they are complex and costly and leave much to be desired.

It is an object of this invention to provide a novel metal wall stud. It is another object of this invention to provide a novel metal wall stud in the form of a steel channel beam with tabs at its ends to provide easy attachment to horizontal wooden and metal plates. Still other objects will become apparent from the more detailed description which follows.

BRIEF SUMMARY OF THE INVENTION

This invention relates to a metal construction wall stud in the form of a channel beam having in transverse cross-section a rectangular U-shape including a flat bottom wall, two parallel side walls attached perpendicular to the bottom wall, and two short flat lips attached perpendicular to the side walls and facing inwardly toward each other. The bottom and side walls are hole-punched with spaced identical patterns of small holes adapted to receive nails or screws therethrough. The bottom wall contains spaced large holes to receive plumbing or electric wiring therethrough. At the ends of the bottom wall and the side walls are tabs with small holes for nails or screws, the tabs being foldable at right angles to the walls from which they extend.

In specific and preferred embodiments there are two side-by-side tabs, normally bendable in opposed directions, extending from each end of the bottom wall, and there is one tab extending from each end of each side wall for connection to plate, the side wall tab having a length equal to 1–3 times the transverse width of the side wall. One side wall tab is transversely reduced so that two studs with their bottoms opposed and sides nestingly positioned provide a telescopic adjustment therefor.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The features of this invention are best understood by reference to the attached drawings.

Figure 2:
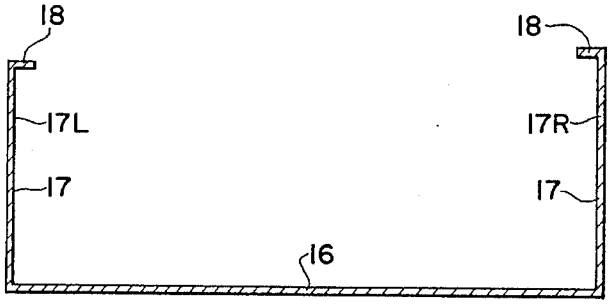
FIG. 2 is a transverse cross-section taken at 2—2 of FIG. 1.

The invention relates to a metal channel beam used to replace a wooden stud beam, normally a 2×4 beam, and other similar common wooden beams, e.g., 2×6, 2×8, 2×10, 2×12, 4×4 and the like. The novel metal beam 10 is shown in cross-section in FIG. 2 to have a bottom wall 16, two side walls 17, and two short lips 18. Side walls 17 are perpendicular to bottom wall 16 and are positioned at the longitudinal edges of bottom wall 16 so as to form a channel. Lips 18 are perpendicular to side walls 17 with one longitudinal edge of lip 18 attached to the remaining longitudinal edge of side wall 17. These walls 16 and 17 and lips 18 form the outline of a rectangle exactly the same size as the wooden beam it is meant to replace. Thus for a replacement for a 2×4 wooden beam, side walls are 2 inches nominally (actually 1.875–1.5 inches) and bottom wall 16 is 4 inches nominally (actually 3.75–3.5 inches). Lip 18 may vary in length, but should remain short, e.g., 0.05–0.15 inch. The metal stock from which the wall stud is made may be any metal, but for availability and cost purposes should be steel, having a thickness of 14–26 gauge, although for special purposes may be lighter or heavier gauge. The wall stud may be made in a variety of lengths, i.e., from one transverse end 19 to the other transverse end 19, in the same manner as wooden beams. Such lengths might generally include 6, 8, 10, 12, 14, 16, 18, 20, 22 and 24 feet. The longer lengths would be made of heavier gauge, e.g., 14–20, while the shorter lengths might be made of lighter gauge, e.g., 22–26. There are needs for shorter lengths for specialty purposes, as will be discussed below in connection with FIG. 8.

The wall stud of this invention is preferably pre-punched with two types of holes, 13 and 14, so as to make the stud more convenient to use than other metal studs known today. Small holes 13 are assembled in a patterned group 27 and identical groups 27 are spaced longitudinally along the length of stud 10. The pattern of holes 13 is identical and the orientation of the pattern is identical for every group 27 on the stud. This identicalness permits horizontal beams to be attached to vertical beams (see FIG. 8), and the horizontal beams will be level, if the vertical beams have been made plumb. The exact spacing and location of small holes 13 in each pattern is not critical so long as each pattern is identical so as to be aligned with other holes in other beams or tabs. Spacing between adjacent groups 27 may be selected as desired, although it is preferred to be about 3–6 inches, most desirably about 4 inches.

Figure 1:
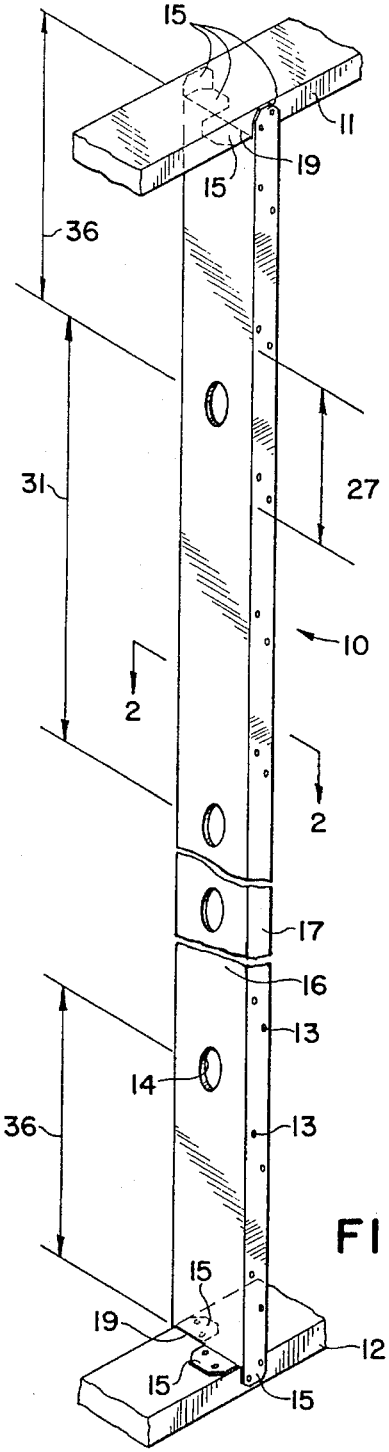
FIG. 1 is a perspective view of a first embodiment of the wall stud of this invention mounted between a wooden top plate and a wooden bottom plate.

Large holes 14 are expected to be used for guiding and supporting plumbing lines and electric lines. Holes 14 are expected to be about 1–1½ inch in diameter, preferably about 1¼ inch. The spacing between adjacent holes 14 is also not critical and preferably is about 2 feet. A preferred arrangement is shown in FIG. 1 with the first hole spacing 36 at each end of stud 10 being about 1 foot from the end 19 and all remaining spacings 31 being about 2 feet.

At each end of each wall 16 and 17 there are tabs 15 of various sizes and arrangements that are used for attaching stud 10 to other construction pieces. For example, in FIG. 1 tabs 15 provide integral means for attaching stud 10 to top plate 11 and the bottom plate 12. In this embodiment, the end of side wall tabs 15 should be spaced slightly above the lower surface of plate 12. If plates 11 and 12 are wooden, tabs 15 can be fastened to plates 11 and 12 by nails through small nail holes in the tabs 15. Screws can, of course, be used if desired. If plates 11 and 12 are also metal, the attachment of tabs 15 thereto can be by self-tapping screws, rivets, nuts and bolts, and the like. Nails used for this purpose are generally of the 8–16 penny size. Tabs 15 may take various sizes and arrangements. As may be seen in FIG. 1 side wall tabs 15 at the transverse ends of stud 10 include a single tab at each end of side wall 17, and double, side-by-side tabs at each end of bottom wall 16. The double tabs 15 are bent oppositely and at right angles to wall 16 and fastened to the appropriate plate 11 or 12. Such connection provides lateral stabilization with a positive connection to both sides of the bottom wall 16. Load bearing capability is also provided assuming the gauge is 20 gauge or thicker. Tabs 15 at the ends of side walls 17 are fastened with nails or screws to the short sides of plates 11 or 12. These tabs eliminate the need to toe-nail studs to plates or provide other connection straps or angles, as was necessary in the prior art when studs and plates were both wooden.

Figure 3:
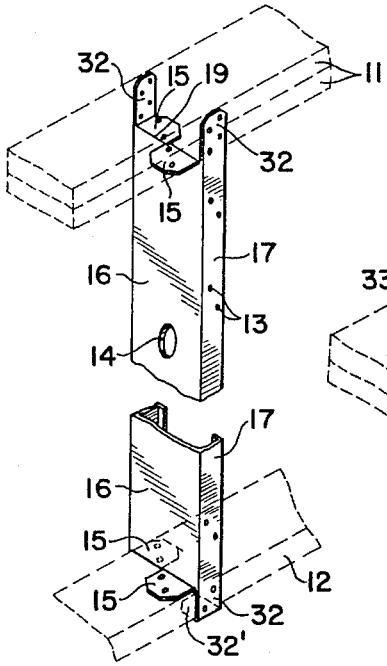
FIG. 3 is a perspective partial view of a second embodiment of the wall stud of this invention.
Figure 4:
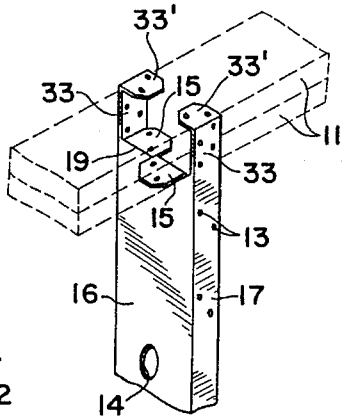
FIG. 4 is a perspective partial view of a third embodiment of the wall stud of this invention.

FIGS. 3 and 4 show alternate embodiments for tabs 15 at the ends of side walls 17. In these drawings the top plate 11 comprises two wooden beams 11. In FIG. 3 the single side wall tab 15 of FIG. 1 has been replaced by a double length tab 32 with nail holes 13 for each of the wooden beams 11. Also each end of the stud of FIG. 3 may be the same, so that the double length tab 32 is bent at the bottom edge of plate 12 to extend beneath plate 12 to dispose its free end portion 32' below the lower surface of bottom plate 12. In FIG. 4 the double length 32 of FIG. 3 has been replaced by a triple length tab 33 with its free end portion 33' bent over the top surface of the top beam 11. These constructions provide for greater uplift capability to the stud. It is to be noted that the end of tabs 15 are slightly spaced upwardly from the lower surface of plate 12 so that the studs 10 do not engage the concrete slab which is typical. If such tabs 15 did engage the concrete slab, as for example in the embodiment shown in FIG. 3, all the metal studs may require a grounding wire interconnecting all studs to ground. It can be seen that these and other arrangements may be desired for special situations.

Figure 5:
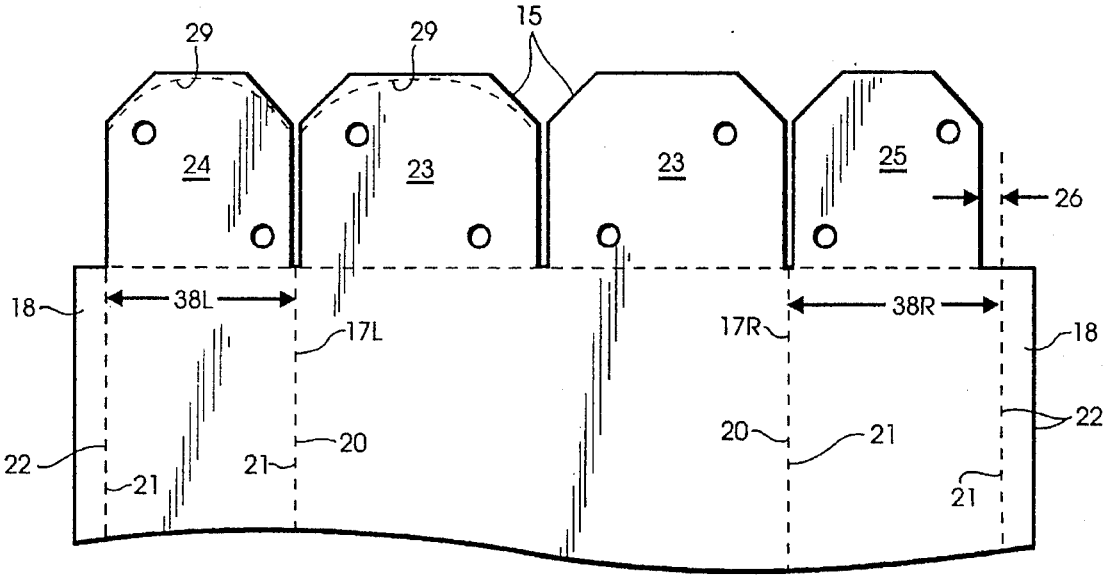
FIG. 5 is a top plan view of the blank from which the wall stud of this invention is made.
Figure 6:
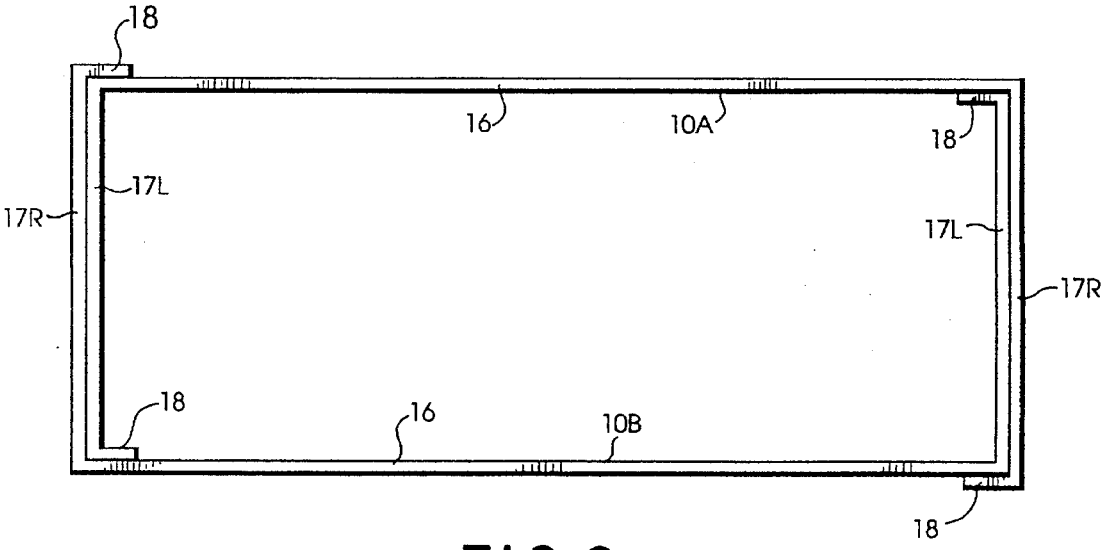
FIG. 6 is a schematic cross-section of two wall studs of this invention joined to make a sliding telescopic wall stud.

FIGS. 5 and 6 show additional aspects in the features of stud 10 which may be beneficially employed. Two studs 10 of this invention can be combined, as shown in FIG. 6, to produce a telescopically extendable stud beam. The two studs 10A and 10B can be placed together as in FIG. 6 and they will slide lengthwise relative to each other, and in that way can be considered a telescopically extendable stud. Each stud 10A and 10B has one side wall 17 totally within the side wall 17' of the other stud.

In order for two beams to be combined as in FIG. 6 it is preferable that the beams be made in accord with the blank for the stud shown in FIG. 5. A flat sheet of steel is cut and punched with holes to form the blank of FIG. 5. Solid lines represent cut edges and broken lines represent fold lines which generally are not visible and are not physically different than the untouched areas between fold lines. In order to transform the blank of FIG. 5 to the stud beam of FIGS. 1–2 the sheet is folded along lines 20 and 21 to produce an elongated generally open channel having inwardly directed lips 18 extending substantially parallel to bottom wall 16. Tabs 15, 15L and 15R can be bent along line 19 to conform to the wooden plate 11 or 12 or which stud beam 10 is to be attached by way of nail holes 13. Tabs 15 need not be shaped with cut off corners (as shown in solid lines) but may be curved (as shown in dotted lines 29) or otherwise shaped, e.g. square with rounded corners, or the like.

It is preferred, when making studs 10 to be useful in telescopic combination (as in FIG. 6) to modify the tabs attached to side walls 17. One of those side walls should be made slightly narrower transversely than the other. In FIG. 5, side wall 17L has a width 38L while side wall 17R has a width 38R. The width 38L is slightly less than the width 38R by the amount shown approximately at 26, i.e., to accommodate about twice the thickness of the metal. When two studs 10A and 10B are to be used telescopically, as shown in FIG. 6, it is preferable that studs 10A and 10B be made as shown in FIG. 5 with side wall 17L slightly narrower than side wall 17R so that the stud 10A with narrower wall 17L will nest within and be juxtaposed to another stud 10B wider wall 17R and stud 10A with wider wall 17R being juxtaposed to stud 10B narrower wall 17L. In other words between lip 18 and bottom wall 16 of stud 10B is disposed bottom 16 and lip 18 of stud 10A with respective walls 17R and 17L being slidingly juxtaposed. Likewise, side wall 17R of stud 10A is slidingly juxtaposed with wall 17L of stud 10B.

Figure 7:
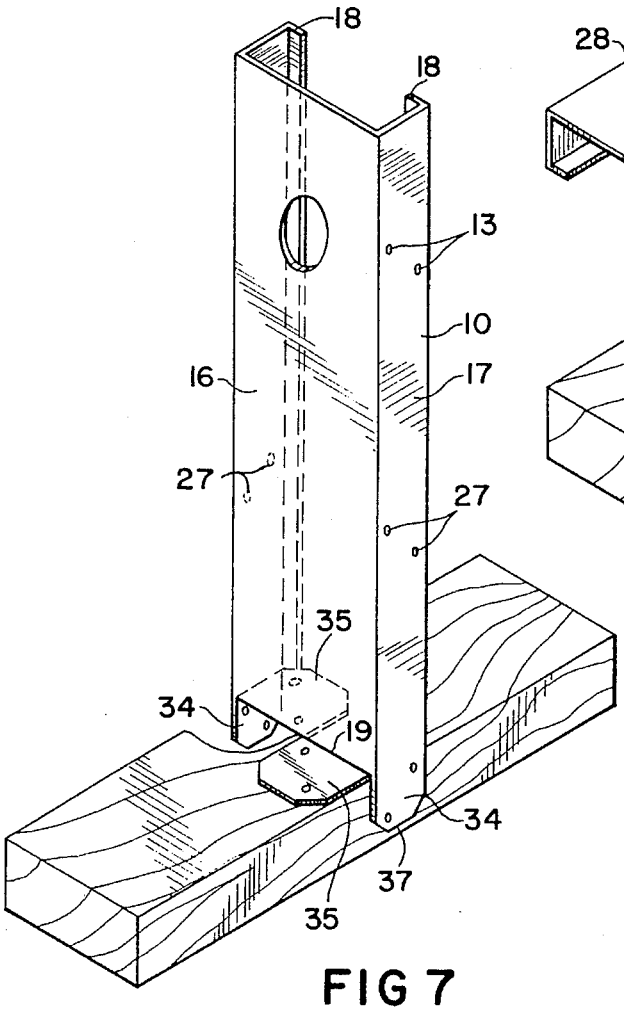
FIG. 7 is a perspective view of the connection of the wall stud of this invention to a wooden bottom plate.
Figure 8:
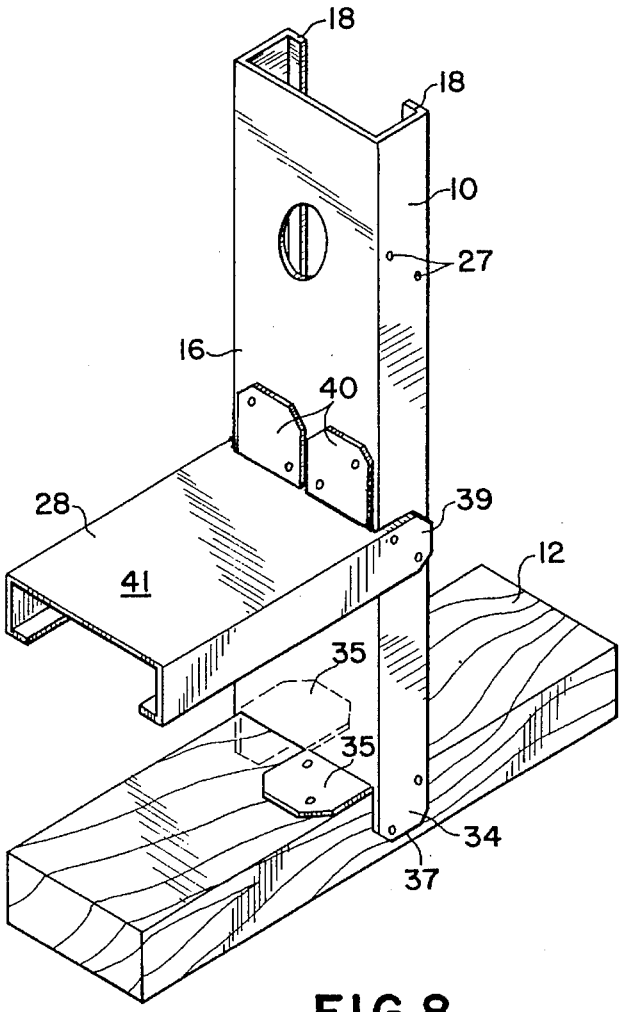
FIG. 8 is a perspective view of two wall studs of this invention to frame a window.

FIGS. 7 and 8 show the way in which studs 10 and their tabs are attached to wooden beams and to horizontal stud beams. In FIG. 7 there is shown the normal connection of stud 10 to bottom plate 12. Stud 10 is placed vertically with transverse end 19 resting on the top of plate 12 and side wall tabs 34 extending downwardly from side walls 17 on each side straddling wooden plate 12 permitting nails to be driven horizontally through the small holes into beam 12. The central side-by-side tabs 35 extending downwardly from bottom wall 16 are bent at right angles so as to lie flat against the top surface of beam 12 and can be nailed down there. Both tabs 35 can be bent, if required, in the same direction or each in opposite directions, to provide lateral stabilization and a positive connection on both sides of bottom 16 of stud 10, as shown in FIG. 7. It is also to be noted that preferably tab 34 is shorter than the thickness of plate 12 by a small amount 37. This is preferred to be sure that beam 10 can be put in place without the necessity of filing the lower edge of tab 34 if that tab should be too long, and, as aforesaid, would not require grounding of the metal stud.

In FIG. 8 there is shown the same connection as in FIG. 7 with the addition of a horizontal metal beam member 28, which may be used as a part of the framing for a window or the like. In this instance there is used a metal stud beam of exactly the same features as those shown in stud 10 of FIGS. 1–2 except that the metal stud beam 28 is shorter than the usual 8–12 foot lengths. Shorter beams can be made to lengths that will be used for window framing, e.g., in multiples of the horizontal distance between adjacent vertical studs, e.g., multiples of 16-inch spacings. Attachments of horizontal beam 28 to vertical stud 10 are made through tabs 39 and 40 on the end of horizontal beam 28 and groups 27 of small pre-punched holes, as shown in side walls 17 of FIG. 7. It may be seen that patterns of small holes in groups 27 can be standardized with hole patterns in tabs 39 so that there will be alignment of holes to receive a connecting screw or bolt-and-nut. With spacings of groups 27 every 4 inches, it is likely that a window frame support can be made of horizontal stud beam 28 which would automatically be level by attachment of beam 28 at each end to the comparable group 27 of small holes on two horizontally spaced studs 10. Tabs 40, similar to tabs 35 in FIG. 7 can be included as desired to help secure beam 28 to beam 10, and can either be both turned upwardly as shown or reversed 180° to lie below the bottom 41 of beam 28. Suitable self-tapping screws can be used to connect tabs 40 to the bottom 16 of stud 10.

As can be determined from the above description the metal stud of the present invention provides a load bearing capability when fabricated from 14–20 gauge sheet steel, has lateral stabilization by providing positive connection by the integral split tabs bent in opposed directions and connected to the plate, integral side wall tabs connected to the sides of the plate or plates and/or bent over (under) the plate or plates and connected thereto to provide enhanced uplift loads and eliminating the need to use separate hurricane clips and metal plates and the like, and providing telescopic capability in using two of the U-shaped studs in a nesting and sliding relationship forming a box beam configuration.

Comparing the uplift loads of various nail sizes useable on the steel stud (two nails in each side tab) of this invention with a conventional Southern yellow pine stud being end nailed to a plate illustrates the enhanced utility of this invention:

| | conventional | steel stud |
|---|---|---|
| 4-8d nails | 164# | 640# |
| 4-10d nails | 184# | 722# |
| 4-16d nails | 200# | 928# |

of course, when the tabs are extended to connect to the second top plate and bent under and connected to the bottom plate four more nails are used at the top (and bottom) tab and the uplift load is accordingly at least doubled. When the upper tab is also extended and bent over the top most plate of a dual upper plate, the uplift load is greatly enhanced approaching the shear capacity of the metal stud or the breaking of the wood plate.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A metal construction wall stud having an elongated channel beam having in transverse cross section a rectangular U-shape including a flat planar bottom wall, two parallel spaced planar side walls perpendicular to the bottom wall, a pair of short inwardly directed lips attached to each side wall and spaced from the bottom wall, the improvement comprising a pair of spaced tabs attached respectively to the side walls at each end thereof and extending beyond the end of the bottom wall and being hole-punched for the receipt of a fastening member therethrough, said spaced tabs being adapted to span respective side walls of each of a top and a sole plate of a wall, a pair of foldable tabs attached to the bottom wall at each end thereof and adapted to be bent perpendicular to the bottom wall and being hole-punched for the receipt of a fastening member therethrough for attachment to facing walls of a top and a sole plate.

2. The stud of claim 1 additionally including a plurality of spaced small punched holes along each said side wall for fastening members in a preselected pattern extending over the length of the beam.

3. The stud of claim 2 wherein said spaced small holes are arranged in spaced patterns of small holes, the spacing of patterns on each stud being identical as measured from an end of the bottom wall.

4. The stud of claim 1 wherein said spaced tabs extend a pre-determined distance to connect to each plate of a dual top plate construction.

5. The stud of claim 1 wherein the length of said tab at the end of each side wall is 1–3 times the transverse width of the side wall.

6. The stud of claim 1 wherein said pair of foldable tabs are formed from the bottom wall and extend generally the width of the bottom wall, said foldable tabs being adapted to be folded at right angles to the bottom wall and opposite each other along a common plane to lie on a plate to which said foldable tabs are to be connected.

7. A frame comprising four studs as defined in claim 1 joined together to form a rectangular frame for a window.

8. The stud of claim 1 wherein one of the side walls of said channel beam is slightly narrower than another of said side walls to provide nesting of another identical stud with said stud.

9. A box beam comprising two studs as defined in claim 8 nested together to form a box beam with one of said studs being in longitudinal telescopic sliding relationship with the other stud.

10. The stud of claim 8 wherein said tabs integral with said side walls are substantially equal in the transverse direction.

11. The stud of claim 8 wherein said another side wall is larger in the transverse direction than twice the thickness of the metal forming the said stud.

12. A metal construction wall integral stud having a channel with a U-shaped rectangular transverse cross section having a flat planar bottom wall with a pair of spaced longitudinal edges and a pair of transverse end edges perpendicular to the longitudinal edges; two spaced and flat planar side walls each having two longitudinal edges; two flat planar lips each having a longitudinal edge and a free longitudinal edge and two transverse end edges perpendicular to the longitudinal edges; one longitudinal edge of each side wall being integrally attached respectively to the pair of longitudinal edges of the bottom wall; the longitudinal edge of each lip being integrally attached respectively to the other longitudinal edge of each side wall, the transverse ends of the bottom wall, the side walls and the lips being aligned, the bottom wall and the lips being spaced about and being perpendicular to the side walls; the improvement comprising tabs extending longitudinally outwardly from each said transverse end of said bottom wall and said side walls and being hole-punched at least twice for receiving fastening members therethrough for connection of each said tab adjacent one end of said stud respectively to spaced vertical side walls and a horizontal wall of a sole plate of a wall and each said tab adjacent another end of said stud respectively to spaced vertical side walls and a horizontal wall of a top plate of a wall.

13. The stud of claim 12 wherein said tab connected to each of the transverse ends of said bottom wall is longitudinally split for bending 90° and disposing one portion thereof on each side of said bottom wall to provide lateral stability to said stud when connected to a plate of a wall.

14. The stud of claim 12 wherein said tabs connected to said side walls extend twice the length of said tabs connected to said bottom wall, said tabs connected to said side walls and locatable adjacent a sole plate of a wall being bent generally medially thereof to dispose a portion below a sole plate of a wall adapted to be connected thereat by fastening members.

15. The stud of claim 12 wherein one of said side walls has a transverse width less than another of said side walls.

16. A metal construction wall stud, including an integral blank having an elongated rectangular bottom wall, a pair of elongated rectangular side walls and a pair of elongated rectangular lips, said side walls being connected to said bottom wall along respective spaced longitudinal fold lines, said lips being connected to respective said side walls along respective spaced longitudinal fold lines, said blank being foldable along said fold lines to dispose said side walls perpendicular to said bottom wall and substantially parallel to each other and to dispose said lips perpendicular to said side walls and spaced and parallel to said bottom wall, the improvement comprising end tabs extending from each end of each of said bottom and side walls, said end tabs connected to said side walls being substantially parallel when the blank is folded to receive therebetween a plate of a wall for connection thereto, said end tabs connected to said bottom wall having a longitudinal split to form a pair of tabs adapted to be bent 90° to dispose same on opposite sides of said bottom wall for connection to a plate of a wall.

17. The stud of claim 16 wherein the width of one of said side walls is narrower than the width of another of said side walls.

18. The stud of claim 16 wherein said one side wall is narrower in width by at least twice the thickness of said blank.

19. The stud of claim 16 wherein said tabs each include at least a pair of spaced holes for receiving therethrough fasteners to connect same to a plate of a wall.

20. The stud of claim 16 wherein each tab extends in the longitudinal direction at least 1–3 times the transverse width of said side wall.

* * * * *